US008386319B1

(12) United States Patent
Banerjee et al.

(10) Patent No.: US 8,386,319 B1
(45) Date of Patent: Feb. 26, 2013

(54) STUDENT PROSPECTS ASSESSMENT SYSTEM

(75) Inventors: Sudeshna Banerjee, Waxhaw, NC (US); Debashis Ghosh, Charlotte, NC (US); Nicholas Halpern, Boston, MA (US); Sreedevi Gummuluri, Charlotte, NC (US); David Joa, Irvine, CA (US); Thayer Allison, Charlotte, NC (US); Kurt D. Newman, Matthews, NC (US); Sean Michael Jones, Charlotte, NC (US)

(73) Assignee: Bank of America Corporation, Charlotte, NC (US)

( * ) Notice: Subject to any disclaimer, the term of this patent is extended or adjusted under 35 U.S.C. 154(b) by 843 days.

(21) Appl. No.: 12/339,248

(22) Filed: Dec. 19, 2008

(51) Int. Cl.
*G06Q 30/00* (2012.01)

(52) U.S. Cl. ..... 705/14.66; 705/7.11

(58) Field of Classification Search ..... None
See application file for complete search history.

(56) References Cited

U.S. PATENT DOCUMENTS

| | | | | |
|---|---|---|---|---|
| 6,061,057 | A * | 5/2000 | Knowlton et al. | 715/744 |
| 6,141,006 | A * | 10/2000 | Knowlton et al. | 705/27.1 |
| 6,515,681 | B1 * | 2/2003 | Knight | 715/751 |
| 7,665,657 | B2 * | 2/2010 | Huh | 235/379 |
| 2006/0178932 | A1 * | 8/2006 | Lang | 705/14 |

* cited by examiner

*Primary Examiner* — Faris Almatrahi
(74) *Attorney, Agent, or Firm* — Michael A. Springs; Moore & Van Allen, PLLC; Padowithz Alce

(57) ABSTRACT

Embodiments of the present invention relate to systems, methods, and computer program products for assessing student prospects. More specifically, embodiments of the present invention are directed to receiving transaction data from a transaction involving a consumer, comparing the transaction data to an education position rule, and determining an education position based at least partially on a comparison of the transaction data to an education position rule.

54 Claims, 5 Drawing Sheets

STUDENT PROSPECTS ASSESSMENT SYSTEM

FIELD

In general, embodiments of the present invention relate to systems, methods, and computer program products for assessing student prospects. More specifically, embodiments of the present invention relate to receiving and analyzing transaction data and, based at least partially thereon, identifying households with past, current, and/or potential students, and targeting those households with relevant education products.

BACKGROUND

Today's education-related marketing efforts are largely unsuccessful because not enough information is known about the households targeted. For example, there is no reliable method of generating information that can consistently identify how many past, current, and/or potential students are living within a household.

Conversely, many past, current, and/or potential students are unaware of the products offered by business-merchants that can assist them and/or their family members in preparing, saving, and paying for their education. For example, many people are unaware that some banks offer a wide variety of student loans products, 529 plans, and/or other savings plan programs that can help cover educational expenses.

Accordingly, it would be desirable if a system, method, and/or computer program product could be provided to assist business-merchants in identifying households with past, current, and/or potential students. It would further be desirable if such a system, method, and/or computer program product could assist past, current, and/or potential students in choosing education-related products tailored to fit their needs.

BRIEF SUMMARY OF EMBODIMENTS OF THE INVENTION

Embodiments of the invention provide systems, methods, and computer program products for assessing student prospects based at least partially on transaction data. For example, in one embodiment, a system is provided having a communication interface configured to receive transaction data from a transaction involving a consumer, and further having a processor operatively coupled to the communication interface and configured to determine an education position based at least partially on a comparison of the transaction data to an education position rule.

In one embodiment of the system, the processor is further configured to determine a product offer for the consumer based at least partially on the education position. In another embodiment of the system, the processor is further configured to offer the product offer to the consumer. In one embodiment of the system, the education position is at least partially related to an education level. In another embodiment of the system, the processor is further configured to determine a geographic location position based at least partially on a comparison of the transaction data to a geographic location position rule. Further, in another embodiment of the system, the processor is further configured to determine a product offer for the consumer based at least partially on the geographic location position and the education position.

In one embodiment of the system, the education position is directed to a member of the consumer's household. In another embodiment, the transaction further involves a business-merchant, and the education position rule relates at least partially to the business-merchant. In another embodiment of the system, the transaction further involves a product, and the education position rule relates at least partially to the product. In another embodiment of the system, the transaction further involves a time, and the education position rule relates at least partially to the time.

In one embodiment of the system, the processor is further configured to assign the education position to the consumer. In another embodiment, the transaction involves a business-merchant, and the processor is further configured to assign the education position to the business-merchant. In another embodiment, the processor is further configured to assign the education position to the transaction data. In one embodiment, the communication interface is further configured to communicate the education position to the consumer for verification. And in another embodiment of the system, the communication interface is further configured to receive information about the consumer from the consumer, and the processor is further configured to determine an education position based at least partially on a comparison of the information to an education position rule, and to determine a product offer for the consumer based at least partially on the education position.

Embodiments of the invention further provide a method for assessing student prospects based at least partially on transaction data. For example, in one embodiment, the method includes the events of: (1) receiving transaction data from a transaction involving a consumer; (2) comparing the transaction data to an education position rule; and (3) determining an education position based at least partially on a comparison of the transaction data to an education position rule.

In one embodiment, the method further includes determining a product offer for the consumer based at least partially on the education position. In another embodiment, the method further includes offering the product offer to the consumer. In one embodiment, the method further includes: (1) comparing the transaction data to a geographic location position rule; (2) determining a geographic location position based at least partially on a comparison of the transaction data to a geographic location position rule; and (3) determining a product offer for the consumer based at least partially on the geographic location position and the education position.

In one embodiment of the method, the transaction further involves a business-merchant, and the education position rule relates at least partially to the business-merchant. In another embodiment of the method, the transaction further involves a product, and the education position rule relates at least partially to the product. And in another embodiment, the transaction further involves a time, and the education position rule relates at least partially to the time.

In one embodiment, the method further includes assigning the education position to the consumer. In another embodiment, the transaction involves a business-merchant, and the method further includes assigning the education position to the business-merchant. In another embodiment, the method further includes assigning the education position to the transaction data. In one embodiment, the method further includes communicating the education position to the consumer for verification. And in one embodiment, the method further includes: (1) receiving information about the consumer from the consumer; (2) comparing the information to an education position rule; (3) determining an education position based at least partially on a comparison of the information to an education position rule; and (4) determining a product offer for the consumer based at least partially on the education position.

Embodiments of the invention also provide a computer program product for assessing student prospects based at least partially on transaction data. For example, in one embodiment, the computer program product includes a computer-readable medium having computer-readable program instructions stored therein. The computer program product further includes first instructions configured to receive transaction data from a transaction involving a consumer, second instructions configured to compare the transaction data to an education position rule, and third instructions configured to determine an education position based at least partially on a comparison of the transaction data to an education position rule.

In one embodiment, the computer program product further includes fourth instructions configured to determine a product offer for the consumer based at least partially on the education position. In another embodiment, the computer program product further includes fifth instructions configured to offer the product offer to the consumer. In another embodiment, the computer program product further includes fourth instructions configured to compare the transaction data to a geographic location position rule, fifth instructions configured to determine a geographic location position based at least partially on a comparison of the transaction data to a geographic location position rule, and sixth instructions configured to determine a product offer for the consumer based at least partially on the geographic location position and the education position.

In one embodiment of the computer program product, the transaction further involves a business-merchant, and the education position rule relates at least partially to the business-merchant. In another embodiment of the computer program product, the transaction further involves a product, and the education position rule relates at least partially to the product. In another embodiment, the computer program product further includes fourth instructions configured to assign the education position to the consumer.

Embodiments of the present invention also provide a system having a communication interface configured to receive transaction data from a transaction involving a consumer, a memory configured to store an education position-identifying rule, and a processor operatively coupled to the communication interface and the memory and configured to determine an education position identifier based at least partially on a comparison of the transaction data to an education position-identifying rule.

In one embodiment of the system, the processor is further configured to determine a product offer for the consumer based at least partially on the education position identifier. And in another embodiment, the processor is further configured to offer the product offer to the consumer. In one embodiment of the system, the processor is further configured to determine a geographic location position identifier based at least partially on a comparison of the transaction data to a geographic location position-identifying rule, and the processor is further configured to determine a product offer for the consumer based at least partially on the geographic location position identifier and the education position identifier.

In one embodiment of the system, the transaction further involves a business-merchant, and the education position-identifying rule relates at least partially to the business-merchant. In another embodiment of the system, the transaction further involves a product, and the education position-identifying rule relates at least partially to the product. In another embodiment of the system, the processor is further configured to assign the education position identifier to the consumer.

Embodiments of the invention further provide a method for: (1) receiving transaction data from a transaction involving a consumer; (2) comparing the transaction data to an education position-identifying rule; and (3) determining an education position identifier based at least partially on a comparison of the transaction data to an education position-identifying rule.

In one embodiment, the method further includes determining a product offer for the consumer based at least partially on the education position-identifier. In another embodiment, the method further includes offering the product offer to the consumer. And in another embodiment, the method further includes: (1) comparing the transaction data to a geographic location position-identifying rule; (2) determining a geographic location position identifier based at least partially on the comparison of the transaction data to a geographic location position-identifying rule; and (3) determining a product offer for the consumer based at least partially on the geographic location position identifier and the education position identifier.

In one embodiment of the method, the transaction further involves a business-merchant, and the education position-identifying rule relates at least partially to the business-merchant. In another embodiment of the method, the transaction further involves a product, and the education position-identifying rule relates at least partially to the product. In another embodiment, the method further includes assigning the education position identifier to the consumer.

Embodiments of the invention also provide a system having a communication interface configured to receive an education position, where the education position is determined based at least partially on transaction data from a transaction involving a consumer, a memory configured to store a product offer rule, and a processor operatively coupled to the communication interface and the memory and configured to determine a product offer for the consumer based at least partially on a comparison of the education position to a product offer rule.

In one embodiment of the system, the processor is further configured to offer the product offer to the consumer. In another embodiment of the system, the communication interface is further configured to receive a geographic location position, where the geographic location position is based at least partially on transaction data from a transaction involving a consumer. In another embodiment, the processor is further configured to determine a product offer for the consumer based at least partially on a comparison of the geographic location position to a product offer rule and a comparison of the education position to a product offer rule.

In one embodiment of the system, the communication interface is further configured to receive information about the consumer from the consumer, and the processor is further configured to determine a product offer based at least partially on a comparison of the information to a product offer rule. In another embodiment of the system, the transaction further involves a product, and the product offer rule relates at least partially to the product. And in another embodiment of the system, the transaction further involves a time, and the product offer rule relates at least partially to the time.

BRIEF DESCRIPTION OF THE DRAWINGS

Figure 1:
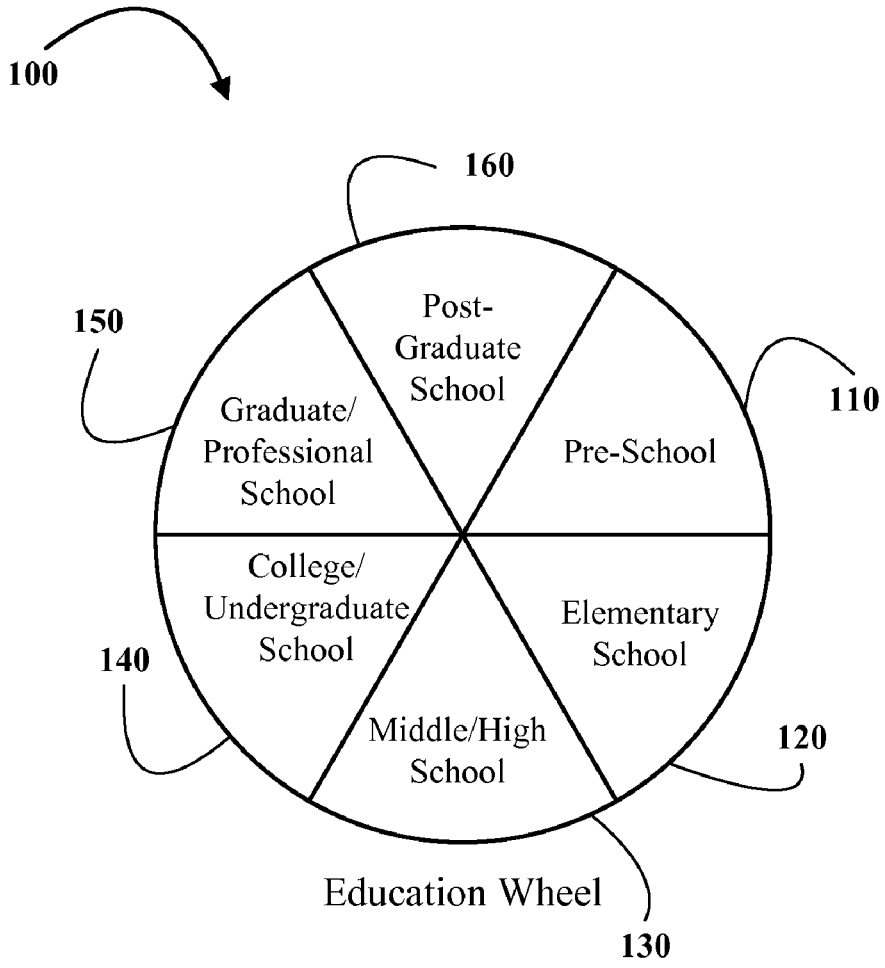
Figure 2:
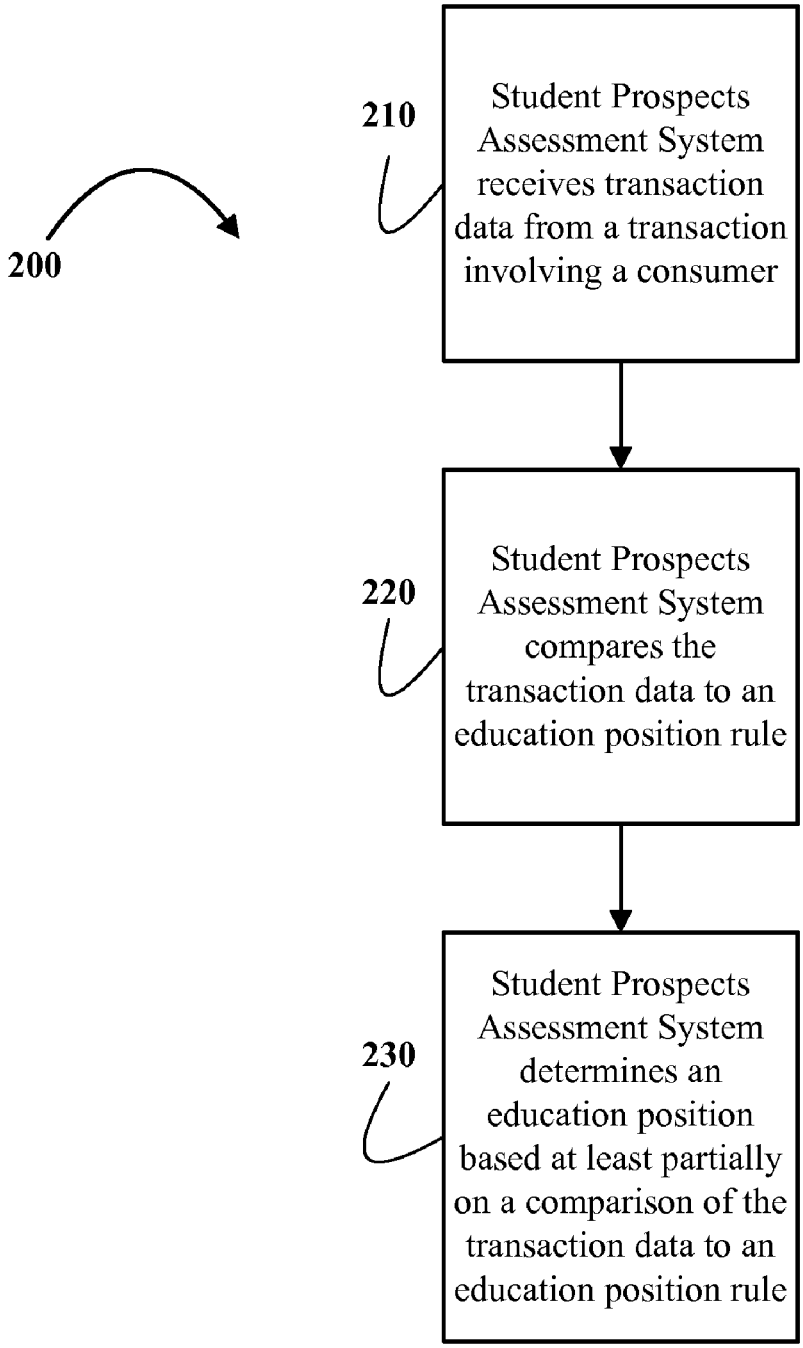
Figure 3:
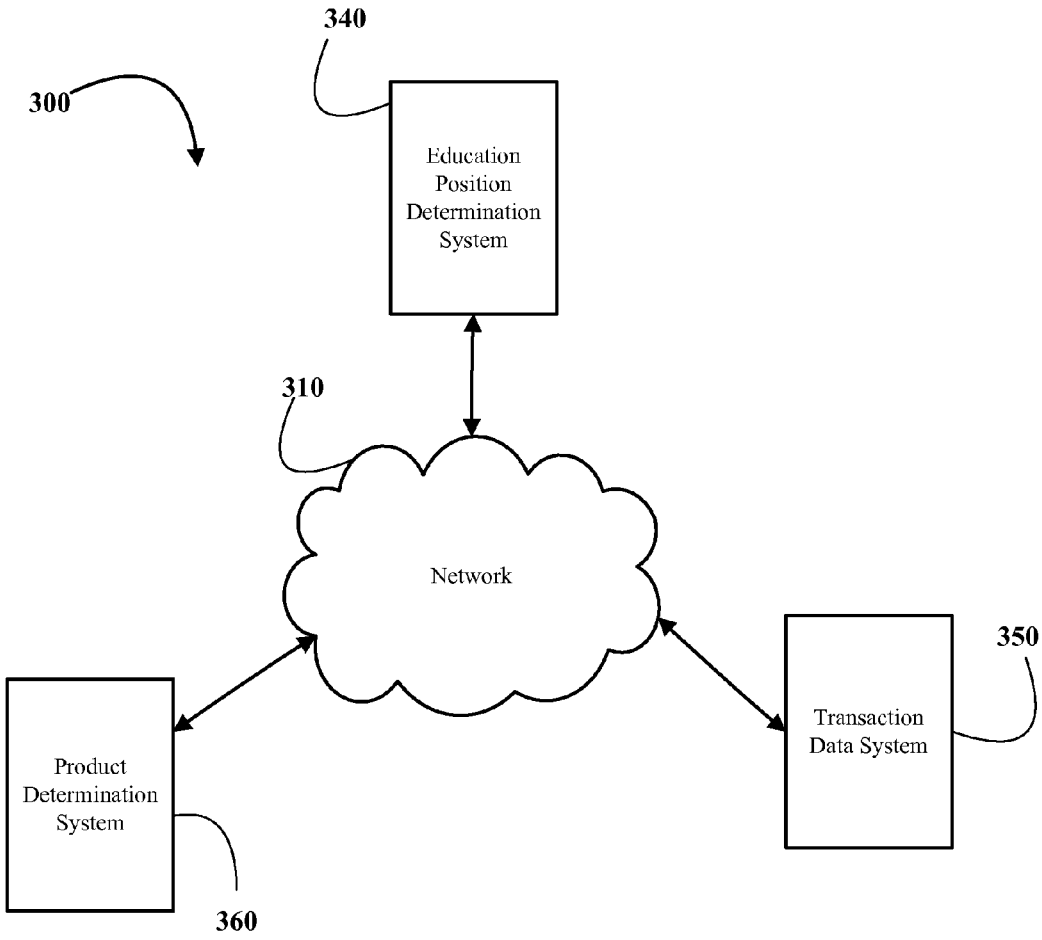
Figure 4:
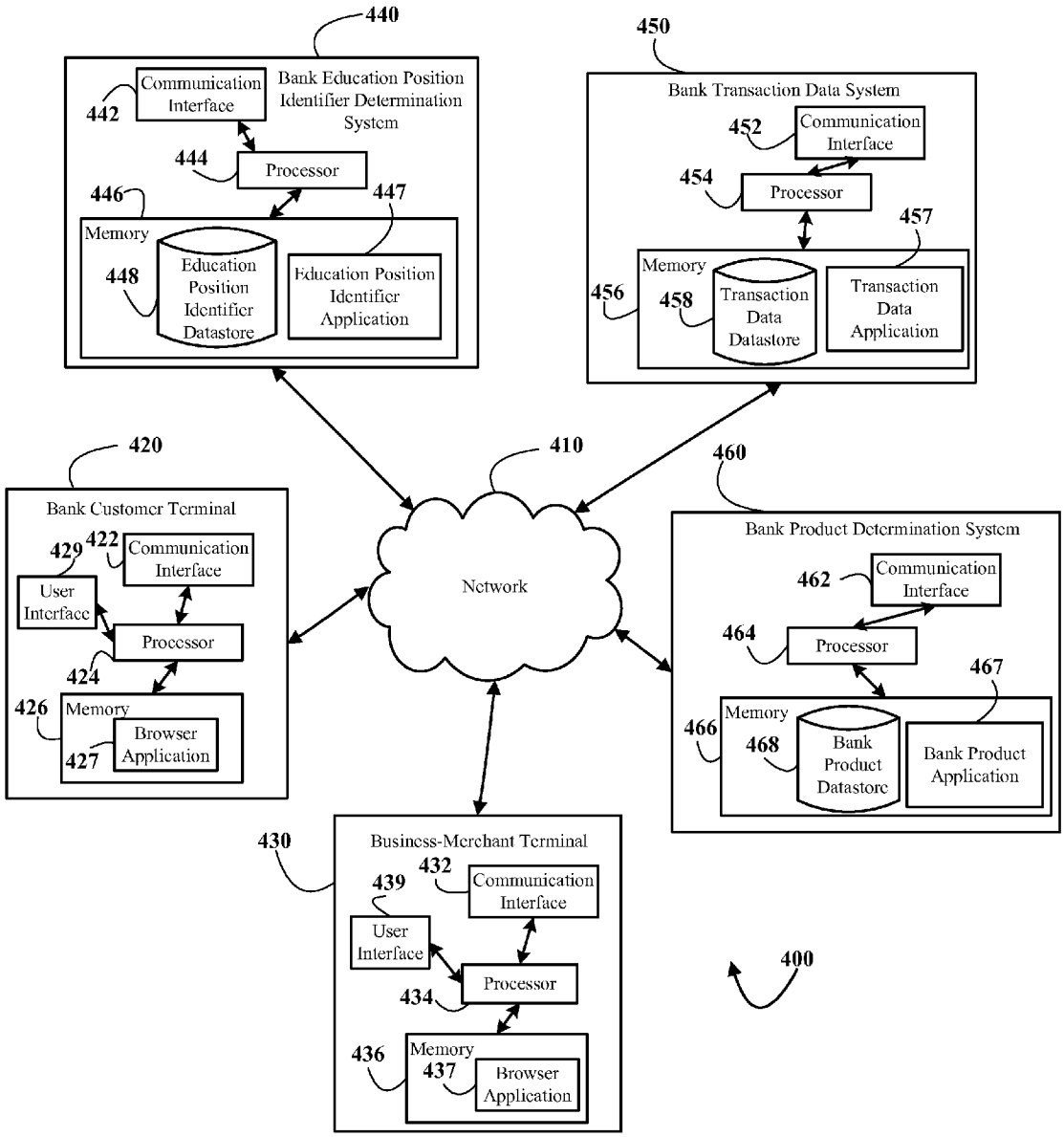
Figure 5:
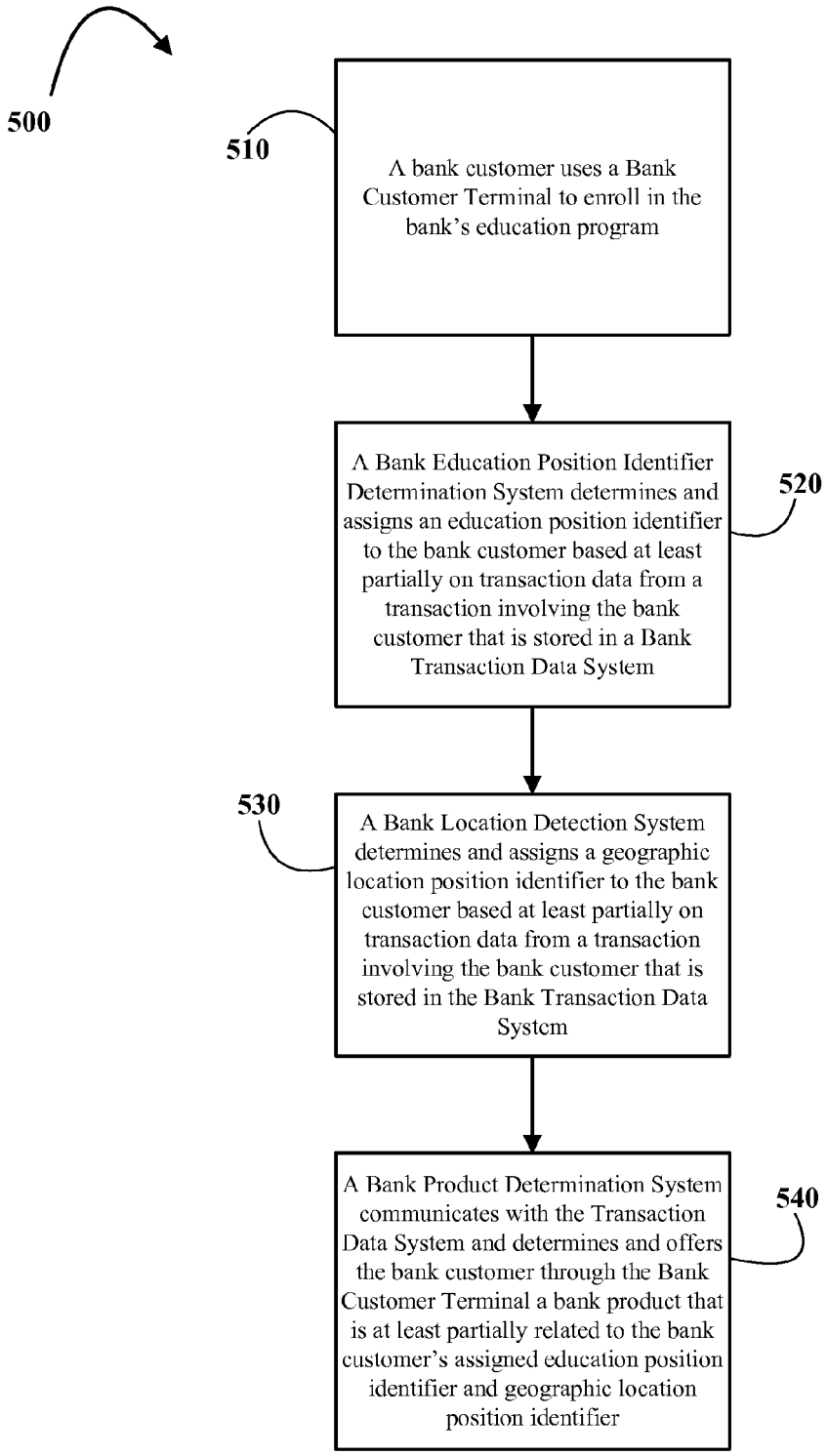

Having thus described embodiments of the present invention in general terms, reference will now be made to the accompanying drawings, which are not necessarily drawn to scale, and wherein:

FIG. 1 illustrates an Education Wheel, in accordance with an embodiment of the present invention;

FIG. 2 illustrates a flow diagram illustrating a general process flow of a Student Prospects Assessment System, in accordance with an embodiment of the present invention;

FIG. 3 illustrates a block diagram illustrating portions of a Student Prospects Assessment System, in accordance with an embodiment of the present invention;

FIG. 4 illustrates a block diagram illustrating high-level components of a Student Prospects Assessment System, in accordance with an embodiment of the present invention; and FIG. 5 illustrates a flow diagram illustrating a general process flow of a Student Prospects Assessment System, in accordance with an embodiment of the present invention.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form, and vice versa. Also, as used herein, the term "a" and/or "an" shall mean "one or more," even though the phrase "one or more" is also used herein. Like numbers refer to like elements throughout.

Although some of the embodiments of the invention described herein are generally described as involving a "bank," one of ordinary skill in the art will appreciate that other embodiments of the invention may involve other businesses and/or financial institutions that take the place of, or work in conjunction with, the bank to perform one or more of the processes, steps, and/or events described herein as being performed and/or participated in by a bank.

As will be appreciated by one of skill in the art, the present invention may be embodied as a system, method, computer program product, or a combination of the foregoing. Accordingly, embodiments of the present invention may take the form of an entirely software embodiment (including firmware, resident software, micro-code, etc.), or an embodiment combining software and hardware aspects that may generally be referred to herein as a "system." Furthermore, embodiments of the present invention may take the form of a computer program product having a computer-readable storage medium having computer-readable program code/computer-readable instructions embodied in the medium.

Any suitable computer-readable medium may be utilized. The computer-readable medium may be, for example but not limited to, an electronic, magnetic, optical, electromagnetic, infrared, or semiconductor system, apparatus, or device. For example, in one embodiment, the computer-readable medium includes a tangible medium such as a portable computer diskette, a hard disk, a random access memory (RAM), a read-only memory (ROM), an erasable programmable read-only memory (EPROM or Flash memory), a compact disc read-only memory (CD-ROM), and/or other tangible optical or magnetic storage device. Note that the computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in computer memory.

Computer program code/computer-readable instructions for carrying out operations of the present invention may be written in an object oriented, scripted and/or unscripted programming languages such as Java, Perl, Smalltalk, C++, SAS, SQL, or the like. However, the computer program code/computer-readable instructions for carrying out operations of the invention may also be written in conventional procedural programming languages, such as the "C" programming language or similar programming languages.

Embodiments of the present invention are described below with reference to flowchart illustrations and/or block diagrams of systems, methods, and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a particular machine, such that the instructions, which execute via the processor of the computer or other programmable data processing apparatus, create means for implementing the functions/acts specified in the flowchart and/or block diagram block or blocks.

These computer program instructions may also be stored in a computer-readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions/acts specified in the flowchart and/or block diagram block or blocks. Alternatively, computer program implemented steps or acts may be combined with operator or human implemented steps or acts in order to carry out an embodiment of the invention.

The term "business-merchant," as used herein, refers to any person, association, machine, apparatus, and/or any other thing capable of selling, offering for sale, distributing, trading, and/or otherwise dealing in one or more goods and/or services. In some embodiments, the business-merchant(s) actually produce and/or provide the goods and/or services being sold, while in other embodiments, the business-merchant(s) distribute the goods and/or services but do not produce and/or provide the goods and/or services. In some embodiments, a business-merchant is a bank or some other financial institution.

The term "product," as used herein, refers to any good and/or service capable of being sold, offered for sale, distributed, traded, and/or otherwise dealt by a business-merchant. In some embodiments, the business-merchant is a bank that offers one or more bank products, including checking account products, savings account products, student loan products, loan consolidation products, and mortgage products, etc.

The term "consumer," as described in many of the embodiments herein, refers to any person, association, machine, apparatus, and/or any other thing capable of buying, using, consuming, and/or acquiring one or more products from a business-merchant. In some embodiments, a consumer may be a business-merchant and/or vice versa. In other embodiments, a consumer may be a customer of a bank or some other financial institution.

The term "transaction data" as used herein refers to any information relating to the sale of a product. Exemplary transaction data includes information about the product(s) exchanged between the consumer and the business-merchant during transactions. Exemplary transaction data also includes information about the consumer, the business-merchant, and the transaction itself. For example, transaction data includes a description of the product(s), the quantity of product(s), and the price of the product(s). Also, for example, transaction data includes the consumer's name and address, bank account number, and credit- or debit-card number and the name of the card-issuing bank. Transaction data also includes, for example, information about the business-merchant, such as the business name and location, the location where the exchange occurred, the name and routing number of the business-merchant's acquiring bank, and the account number of the business-merchant's account, which is held at the acquiring bank. For illustrative purposes, the transaction data will be described herein as transaction data obtained at a point-of-sale when a consumer purchases a product from a business-merchant using a credit or debit card. It should be appreciated, however, that the transaction data could be obtained from other types of transactions, including automated clearing house (ACH) payments, online bill pay, paper checks, wire transfers, contactless payments, and cash payments.

In general terms, described herein are various systems, methods, and computer program products for assessing student prospects. Embodiments of the present invention analyze transaction data involving a consumer to determine whether the consumer was, is, or intends to be a student. More specifically, embodiments of the present invention are directed to receiving transaction data from a transaction involving a consumer, comparing the transaction data to an education position rule, and determining an education position based at least partially on a comparison of the transaction data to an education position rule. In addition, embodiments of the present invention may be configured to determine a product offer for the consumer based at least partially on the education position. Further, embodiments of the present invention may also be configured to assign the education position to the consumer, the transaction data, and/or to a business-merchant involved in the transaction.

Accordingly, embodiments of the present invention are particularly useful as a marketing tool for banks, financial institutions, and any other business-merchants that receive large amounts of transaction data. Embodiments of the present invention improve the yield of direct mailing campaigns and other marketing efforts, and can be used to verify third-party demographic information. Embodiments of the present invention also help business-merchants identify "stealth" students living in a consumer's household and target them as potential new customers earlier in their education experience.

The one or more education positions described herein may be directed to any information related to education. For example, Education Wheel 100 in FIG. 1 includes six education positions, or pies, that designate different education levels: Pre-School 110, Elementary School 120, Middle/High School 130, College/Undergraduate School 140, Graduate/Professional School 150, and Post-Graduate School 160. In other embodiments of the present invention, Education Wheel 100 may include more, fewer, and/or different positions than those illustrated in FIG. 1. Examples may include kindergarten, junior college, law school, and/or any information related to these education levels. Some embodiments may even include an education position to designate non-students. And in other embodiments, the one or more education positions may not relate to an education level at all. Moreover, some embodiments may refer to some graphic method other than an Education Wheel to designate education positions, such as, for example, an Education Timeline or an Education Pyramid. Still further, in some embodiments, the one or more education positions may be one or more education position identifiers configured to be appended to transaction data and/or appear in a computer profile, but it should be understood that any other form for conveying the information may be used instead.

FIG. 2 provides an exemplary flow diagram illustrating the general process flow 200 of a Student Prospects Assessment System, in accordance with an embodiment of the present invention. As represented by block 210, the Student Prospects Assessment System receives transaction data from a transaction involving a consumer. The Student Prospects Assessment System also compares the transaction data to an education position rule, as represented by block 220. In addition, the Student Prospects Assessment System determines an education position based at least partially on a comparison of the transaction data to an education position rule, as represented by block 230.

In some embodiments of the present invention, the Student Prospects Assessment System is configured to obey one or more rules for determining an education position. In one embodiment, the Student Prospects Assessment System is configured to determine an education position based at least partially on the business-merchant involved in the transaction. For example, if a consumer's transaction data includes a payment for any kind of Facebook® product, the Student Prospects Assessment System may determine the education position "middle/high school" merely because the term "Facebook®" appeared in the transaction data. In this example, the Student Prospects Assessment System may be configured to obey an education position rule that assumes that teenagers and young adults—likely middle or high school students—are the likeliest consumers of Facebook® products.

In another embodiment of the present invention, the Student Prospects Assessment System is configured to determine an education position based at least partially on a product involved in the transaction. For example, if a consumer's transaction data includes a payment for an LSAT® (Law School Admission Test) Review Course, the Student Prospects Assessment System may be configured to automatically determine the education position "graduate/professional school" merely because the term "LSAT®" appeared in the transaction data. In this example, the Student Prospects Assessment System may be configured to obey an education position rule that assumes that any consumer purchasing a review course for the LSAT® is preparing to enter law school.

It will be appreciated that the Student Prospects Assessment System may be configured to obey other rules for determining education positions. For example, the Student Prospects Assessment System may be configured to determine education positions based at least partially on the time of year a transaction takes place, where the transaction takes place, the amount of the payment involved in the transaction, the age of the consumer and/or business-merchant involved in the transaction, and/or anything else about the transaction. Some embodiments of the Advertising Channel System may also be configured to determine an education position for a party based at least partially on a comparison of an education position rule to information about the party provided by the party.

Further, it will be appreciated that the order of the events described in blocks 210, 220, and 230 in FIG. 2 may vary. For example, the Student Prospects Assessment System may receive transaction data from a transaction involving a consumer data before or substantially simultaneous with comparing the transaction data to an education position rule. As another example, the Student Prospects Assessment System may determine an education position after or substantially simultaneous with comparing the transaction data to an education position rule.

In some embodiments, general process flow 200 may include fewer, additional, and/or different events. For example, in at least one embodiment, the Student Prospects Assessment System may also determine a product offer for the consumer based at least partially on the education position. For example, the Student Prospects Assessment System may be configured to determine a student loan product for the education position "middle/high school" based on an education position rule that assumes that middle/high school students are the demographic most likely interested in obtaining financing to attend college or university. As another example, the Student Prospects Assessment System may be configured to determine a mortgage product for the education position "graduate/professional school" based on an education position rule that assumes that graduate and professional school students are likely to be home buyers.

Further, in some embodiments, the Student Prospects Assessment System may be configured to assign the education position to the consumer, the transaction data, and/or a business-merchant involved in the transaction. For example, the Student Prospects Assessment System may be configured to assign the education position "college/undergraduate school" to a consumer having transaction data that includes a payment to a university, to the transaction data itself, and/or to the university involved in the transaction. In some embodiments of the present invention, an education position assigned to a consumer is really directed to a member of the consumer's household instead of the consumer himself. For example, if a consumer's transaction data includes a payment for private high school tuition, the Student Prospects Assessment System may assign the education position "middle/high school" to the consumer, even though it is a member of the consumer's household, and not the consumer, that is enrolled in the private high school. In this example, the Student Prospects Assessment System may be further configured to offer the consumer and/or the high school student one or more education products related to the "middle/high school" education position, including, for example, student checking account plans and/or college loan products.

Referring now to FIG. 3, Student Prospects Assessment System 300 is provided, which includes Network 310, Education Position Determination System 340, Transaction Data System 350, and Product Determination System 360. As illustrated, each portion of Student Prospects Assessment System 300 is operatively coupled to Network 310.

In at least one embodiment, Education Position Determination System 340 is configured to compare an education position rule to transaction data from a transaction involving a consumer. Additionally, in at least one embodiment, Education Position Determination System 340 is configured to determine an education position based at least partially on a comparison of the transaction data to an education position rule. In at least one embodiment, Transaction Data System 350 is configured to receive, store, and retrieve transaction data from a transaction involving a consumer. In at least one embodiment, Product Determination System 360 is configured to determine a product offer for the consumer based at least partially on the education position.

In at least one embodiment, the various systems of Student Prospects Assessment System 300 are configured to implement one of the various embodiments of general process flow 200 described herein. For example, Transaction Data System 350 may receive transaction data from a transaction involving a consumer, as represented by block 210. Then, as represented by block 220, Education Position Determination System 340 may compare the transaction data to an education position rule. As represented by block 230, Education Position Determination System 340 may also determine an education position based at least partially on a comparison of the transaction data to an education position rule. Afterwards, Product Determination System 360 may determine a product offer for the consumer based at least partially on the education position.

In another embodiment, Student Prospects Assessment System 300 may also include a Business-Merchant Interface System (not shown) that is configured to allow a business-merchant to communicate with the one or more portions of Student Prospects Assessment System 300 and/or vice versa. For example, the Business-Merchant Interface System may be configured to communicate transaction data from a transaction involving a business-merchant to Transaction Data System 350 and/or vice versa. In a typical transaction involving a consumer and a business-merchant, the business-merchant communicates related transaction data via a payment gateway to its acquiring bank, which is the bank that accepts payments for the products on behalf of the business merchant. The acquiring bank then communicates the transaction data to the appropriate card association, e.g., Visa® or Mastercard®, which routes the transaction data, along with the authorization request, to the correct card-issuing bank. The card-issuing bank receives the transaction data and authorization request, and communicates a response back to the acquiring bank with information indicating whether the payment is approved or declined. The acquiring bank then forwards the response to the business-merchant via the payment gateway and the transaction is authorized. So, in some embodiments of the present invention, the Business-Merchant Interface System may be configured to operate as a payment gateway between the business-merchant and its acquiring bank, whereby the acquiring bank uses Transaction Data System 350 to receive, store, and retrieve transaction data from transactions involving the business-merchant. However, in other embodiments, the Business-Merchant Interface System may be configured to perform other and/or additional processes, such as facilitating one or more product offers from Product Determination System 360.

In another embodiment, Student Prospects Assessment System 300 may include a Consumer Interface System (not shown) that is configured to allow a consumer to communicate with one or more portions of Student Prospects Assessment System 300 and/or vice versa. For example, after determining an education position, Education Position Determination System 340 may present the education position to the consumer via the Consumer Interface System and request that the consumer verify the accuracy of the determination. As another example, the consumer may submit education-related information about himself and/or members of his household to various systems of Student Prospects Assessment System 300 via the Consumer Interface System.

Although FIG. 3 depicts Student Prospects Assessment System 300 as having separate Education Position Determination System 340, Transaction Data System 350, and Product Determination System 360, other embodiments of the present invention may differ. For example, some or all of these systems may be combined into a single system, i.e. Education Position Determination System 340 and Product Determination System 360 may be combined into a single Education Position and Product Determination System configured to determine both an education position and a product offer. Likewise, some or all of the systems in Student Prospects Assessment System 300 may be separated into two or more distinct entities, i.e. Product Determination System 360 may be separated into a Good Determination System configured to determine a good offer for the consumer based at least partially on the education position, and a Service Determination System configured to determine a service offer for the consumer based at least partially on the education position.

In addition, the various systems of Student Prospects Assessment System 300 may be controlled, operated, managed, stored, and/or maintained, etc. (hereinafter "maintained" for simplicity) by the same or separate parties. For example, in one embodiment, a consumer may maintain the Consumer Interface System (not shown), a business-merchant may maintain the Business-Merchant Interface System (not shown), and a bank may maintain Education Position Determination System 340, Transaction Data System 350, and Product Determination System 360. As another example, a financial institution may maintain each and every portion of Student Prospects Assessment System 300, including any embodiments of the Consumer Interface System and the Business-Merchant Interface System as described herein.

Referring now to FIGS. 4 and 5, an exemplary Student Prospects Assessment System 400 and general process flow 500 are provided to give a more detailed description of one embodiment of the present invention. The system and process described in FIGS. 4 and 5 specifically involve a bank and its customers, but, as mentioned previously, other business-merchants capable of maintaining one or more portions of Student Prospects Assessment System 400 and/or implementing one or more blocks of general process flow 500 may be involved instead. In general terms, Student Prospects Assessment System 400 and general process flow 500 are directed at identifying past, current, and/or potential students in the bank's customer base and offering them a variety of education-related bank products in a coordinated manner. This system and process are scalable, meaning additional and/or different terminals, systems, engines, parties, processes, and/or other products may be added.

More specifically, FIG. 4 provides Student Prospects Assessment System 400, which includes Network 410, Bank Customer Terminal 420, Business-Merchant Terminal 430, Bank Education Position Identifier Determination System 440, Bank Transaction Data System 450, and Bank Product Determination System 460. As illustrated, the bank maintains Bank Education Position Identifier Determination System 440, Bank Transaction Data System 450, and Bank Product Determination System 460. Further, as illustrated, a bank customer maintains Bank Customer Terminal 420, and a business-merchant maintains Business-Merchant Terminal 430. In this embodiment, the bank is the acquiring bank for the business-merchant.

Each of the terminals and systems of Student Prospects Assessment System 400 is operatively coupled to Network 410, which may include one or more separate networks. Network 410 may include a local area network (LAN), a wide area network (WAN), and/or a Global Area Network (GAN), such as the Internet. It should be understood that Network 410 may include wireless and/or wireline technology. Network 410 may be secure and/or unsecure.

In many embodiments, Bank Customer Terminal 420 is configured to allow a bank customer to communicate with other networks and/or portions of Student Prospects Assessment System 400 and/or vice versa. For example, the bank customer may submit education-related information about himself and/or members of his household to various systems of Student Prospects Assessment System 400 via Bank Customer Terminal 420. As another example, the bank customer may enroll in and/or use various bank programs, including those offered by portions of Student Prospects Assessment System 400, via Bank Customer Terminal 420. In one embodiment, Bank Customer Terminal 420 facilitates substantially real-time communication between the bank customer and various portions of Student Prospects Assessment System 400.

Bank Customer Terminal 420 may include, for example, a portion of a computer network, a personal computer system, a mobile phone, a personal digital assistant, a public kiosk, and/or some other type of computing device. In one embodiment, as illustrated, Bank Customer Terminal 420 includes Communication Interface 422, Processor 424, Memory 426 having Browser Application 427, and User Interface 429. Communication Interface 422 is operatively coupled to Processor 424, which is operatively coupled to User Interface 429 and Memory 426 having Browser Application 427.

Each communication interface described herein, including Communication Interface 422, includes hardware, and, in some instances, software, that enables a portion of Student Prospects Assessment System 400, such as Bank Customer Terminal 420, to transport, send, receive, and/or otherwise communicate information to and/or from the communication interface of one or more other portions of Student Prospects Assessment System 400. For example, Communication Interface 422 of Bank Customer Terminal 420 may include a modem, server, and/or other electronic device that operatively couples Bank Customer Terminal 420 to another electronic device, such as the electronic devices that make up Business-Merchant Terminal 430, Bank Education Position Identifier Determination System 440, Bank Transaction Data System 450, Bank Product Determination System 460, and/or one or more networks linking Bank Customer Terminal 420 to these other one or more portions of the Student Prospects Assessment System 400.

Each processor described herein, including Processor 424, includes circuitry required for implementing the audio, visual, and/or logic functions of that portion of Student Prospects Assessment System 400 including the processor. For example, Processor 424 of Bank Customer Terminal 420 may include a digital signal processor device, a microprocessor device, and various analog-to-digital converters, digital-to-analog converters, and other support circuits. Control and signal processing functions of Bank Customer Terminal 420 may be allocated between these devices according to their respective capabilities. Processor 424 may include functionality to operate one or more software programs based on computer-readable instructions thereof, which may be stored, for example, in Browser Application 427 of Memory 426 of Bank Customer Terminal 420.

Each memory device described herein, including Memory 426 for storing the Browser Application 427 and other data, may include any computer-readable medium. For example, Memory 426 of Bank Customer Terminal 420 may include volatile memory, such as volatile Random Access Memory (RAM) including a cache area for the temporary storage of data. Memory 426 may also include other non-volatile memory, which can be embedded and/or may be removable. The non-volatile memory can additionally or alternatively include an EEPROM, flash memory, or the like. Memory 426 can store any of a number of pieces of information and data used by Bank Customer Terminal 420 to implement the functions of Bank Customer Terminal 420.

Browser Application 427 may be any computer-readable instructions configured to allow Bank Customer Terminal 420 to communicate with other devices over a network using, for example, one or more network and/or system communication protocols. For example, in one embodiment, Browser Application 427 includes an Internet Web browser used by Bank Customer Terminal 420 for communicating with various portions of Student Prospects Assessment System 400.

User Interface 429 generally includes one or more user output devices, such as a display and/or speaker, for presenting information to a bank customer. User Interface 429 further includes one or more user input devices, such as one or more keys or dials, a touch pad, touch screen, mouse, microphone, camera, and/or the like, for receiving information from the bank customer.

FIG. 4 also illustrates Business-Merchant Terminal 430 in accordance with an embodiment of the invention. In many embodiments, Business-Merchant Terminal 430 is configured to allow a bank customer to communicate with other networks and/or portions of Student Prospects Assessment System 400 and/or vice versa. In at least one embodiment, Business-Merchant Terminal 430 is configured to communicate transaction data from a transaction involving a business-merchant to Bank Transaction Data System 450 and/or vice versa. For example, Business-Merchant Terminal 430 may be configured to operate as a payment gateway between the business-merchant and the bank, whereby the bank uses Bank Transaction Data System 450 to receive, store, and retrieve transaction data from transactions involving the business-merchant. In one embodiment, Business-Merchant Terminal 430 facilitates substantially real-time communication between the business-merchant and Bank Transaction Data System 450 and/or various other portions of Student Prospects Assessment System 400.

Business-Merchant Terminal 430 may include, for example, a portion of a computer network, a personal computer system, a mobile phone, a personal digital assistant, a public kiosk, and/or some other type of computing device. In one embodiment, as illustrated, Business-Merchant Terminal 430 includes Communication Interface 432, Processor 434, Memory 436 having Browser Application 437, and User Interface 439. Further, Communication Interface 432 is operatively coupled to Processor 434, which is operatively coupled to User Interface 439 and Memory 436 having Browser Application 437.

Browser Application 437 may be any computer-readable instructions configured to allow Business-Merchant Terminal 430 to communicate with other devices over a network using, for example, one or more network and/or system communication protocols. For example, in one embodiment, Browser Application 437 includes an Internet Web browser used by Business-Merchant Terminal 430 for communicating with Bank Transaction Data System 450 and/or various other portions of Student Prospects Assessment System 400.

User Interface 439 generally includes one or more user output devices, such as a display and/or speaker, for presenting information to a business-merchant. User Interface 439 further includes one or more user input devices, such as one or more keys or dials, a touch pad, touch screen, mouse, microphone, camera, and/or the like, for receiving information from the business-merchant.

Also illustrated in FIG. 4 is Bank Education Position Identifier Determination System 440, in accordance with one embodiment of the present invention. Bank Education Position Identifier Determination System 440 may include, for example, a portion of a computer network, an engine, a platform, a network server, a database system, a front end system, a back end system, a personal computer system, and/or some other type of computing device. In one embodiment, as illustrated, Bank Education Position Identifier Determination System 440 includes Communication Interface 442, Processor 444, and Memory 446 having Education Position Identifier Application 447 and Education Position Identifier Datastore 448. Communication Interface 442 is operatively coupled to Processor 444, which is operatively coupled to Memory 446 having Education Position Identifier Application 447 and Education Position Identifier Datastore 448.

In many embodiments, Bank Education Position Identifier Determination System 440 is configured to compare transaction data to an education position-identifying rule and determine an education position identifier based at least partially on a comparison of the transaction data to an education position-identifying rule. The education position identifier may include any of the one or more education positions, or information related thereto, as previously described herein.

In some embodiments, Bank Education Position Identifier Determination System 440 is also configured to assign the education position identifier to a bank customer. In this regard, in one embodiment, Education Position Identifier Application 447 includes computer-readable instructions for instructing Processor 444 to compare the bank customer's transaction data to one or more education position-identifying rules stored in Education Position Identifier Datastore 448, to determine one or more education position identifiers based on that and/or another comparison, and to assign the one or more education position identifiers to the bank customer. For example, Bank Education Position Identifier Determination System 440 may be configured to determine and assign the education position identifier "middle/high school" to a profile of a bank customer that paid for a college entrance exam, merely because the one or more education position-identifying rules assumes that middle and/or high school students are the demographic most likely purchasing such exams. In other embodiments, as described herein, Bank Education Position Identifier Determination System 440 may also be configured to assign one or more education position identifiers to transaction data involving a bank customer, instead of, or in addition to, the bank customer himself. In other embodiments, Bank Education Position Identifier Determination System 440 may be configured to assign one or more education position identifiers to a business-merchant involved in the transaction. In some embodiments, the one or more education position identifiers may be appended to the bank customer's transaction data. For simplicity, however, much of the following description refers to assigning one or more education position identifiers to a bank customer.

In addition to the one or more education position-identifying rules, Education Position Identifier Datastore 448 may also include one or more of the education position identifiers described herein. In at least one embodiment, Education Position Identifier Datastore 448 provides a substantially real-time representation of the one or more education position identifiers and/or of the one or more education position-identifying rules for determining them. Thus, when Processor 444 accesses Education Position Identifier Datastore 448, the information stored therein is substantially current.

In other embodiments, Bank Education Position Identifier Determination System 440 may determine and assign one or more education position identifiers to a bank customer based at least partially on information other than, or in addition to, the bank customer's transaction data. Examples include information about the bank customer's geographic location, information about the bank customer provided by third-parties, information about the bank customer provided by the bank customer herself, and/or information about the bank customer from a network, such as the Internet, etc.

Further, in some embodiments, Bank Education Position Identifier Determination System 440 may be configured to relay information about the one or more education position identifiers that it has determined to one or more bank associates. For example, if a bank customer service associate accesses a bank customer's profile while he is on the phone with the bank customer, Bank Education Position Identifier Determination System 440 may be configured to provide additional information about the bank customer, including any education position identifiers determined from the bank customer's transaction data, via a pop-up screen on the bank customer service associate's computer.

Also illustrated in FIG. 4 is Bank Transaction Data System 450. Bank Transaction Data System 450 may include, for example, a portion of a computer network, an engine, a platform, a network server, a database system, a front end system, a back end system, a personal computer system, and/or some other type of computing device. In one embodiment, as illustrated, Bank Transaction Data System 450 includes Communication Interface 452, Processor 454, and Memory 456 having Transaction Data Application 457 and Transaction Data Datastore 458. Communication Interface 452 is operatively coupled to Processor 454, which is operatively coupled to Memory 456 having Transaction Data Application 457 and Transaction Data Datastore 458.

In many embodiments, Bank Transaction Data System 450 is configured to use Transaction Data Datastore 458 to receive, store, and/or retrieve transaction data from a transaction involving a bank customer. In this regard, in one embodiment, Transaction Data Application 457 includes computer-readable instructions for instructing Processor 454 to send/receive transaction data to/from one or more networks and/or one or more portions of Student Prospects Assessment System 400. For example, Bank Transaction Data System 450 may receive, store, and/or retrieve transaction data sent from a business-merchant via Business-Merchant Terminal 430 and/or from a bank customer via Bank Customer Terminal 420. As another example, Bank Transaction Data System 450 may communicate transaction data stored in Transaction Data Datastore 458 to Bank Education Position Identifier Determination System 440 for use in determining and/or assigning one or more education positions. In some embodiments, Bank Transaction Data System 450 may be configured to receive, store, and/or retrieve information other than, or in addition to, transaction data. For example, Bank Transaction Data System 450 may include one or more education position identifiers that have been assigned to a bank customer. Further, in some embodiments, Transaction Data Datastore 458 provides a substantially real-time representation of the transaction data stored therein. Thus, when transaction data is communicated to any network and/or portion of Student Prospects Assessment System 400, the transaction data communicated is substantially current.

Also illustrated in FIG. 4 is Bank Product Determination System 460. Bank Product Determination System 460 may include, for example, a portion of a computer network, an engine, a platform, a network server, a database system, a front end system, a back end system, a personal computer system, and/or some other type of computing device. In one embodiment, as illustrated, Bank Product Determination System 460 includes Communication Interface 462, Processor 464, and Memory 466 having Bank Product Application 467 and Bank Product Datastore 468. Communication Interface 462 is operatively coupled to Processor 464, which is operatively coupled to Memory 466 having Bank Product Application 467 and Bank Product Datastore 468.

In many embodiments, Bank Product Determination System 460 is configured to determine a product offer for a bank customer based at least partially on one or more education position identifiers determined from the bank customer's transaction data. Further, in some embodiments, Bank Product Determination System 460 may be configured to determine a product offer based at least partially on one or more education position identifiers assigned to the bank customer, the bank customer's transaction data, and/or a business-merchant involved in the transaction. Further, in some embodiments, Bank Product Determination System 460 may be configured to compare an education position identifier to a product offer rule. Bank Product Determination System 460 may further be configured to determine a product offer based at least partially on a comparison of the education position identifier to a product offer rule.

In at least one embodiment, Bank Product Determination System 460 is configured to offer a bank customer one or more bank products at least partially related to one or more education position identifiers determined by and/or assigned to the bank customer, the bank customer's transaction data, and/or a business-merchant involved in the transaction. In this regard, in one embodiment, Bank Product Application 467 includes computer-readable instructions for instructing Processor 464 to compare an education position identifier assigned to a bank customer to a product offer rule stored in Bank Product Datastore 468 and to offer a bank product to the bank customer based at least partially on that and/or another comparison. For example, Bank Product Determination System 460 may be configured to offer a student loan product to a bank customer that has been assigned the education position identifier "middle/high school" based on a product offer rule stored in Bank Product Datastore 468 that assumes that middle and high school students are the demographic most likely interested in obtaining financing to attend college or university. In another example, Bank Product Determination System 460 may be configured to offer a loan consolidation product to a bank customer that has been assigned the education position identifier "graduate/professional school" based on a product offer rule that assumes that graduate and professional school students are the demographic most likely to have multiple student loans. In still another example, Bank Product Determination System 460 may be configured to automatically offer a customized University of North Carolina® credit card to a bank customer that has been assigned the education position identifier "college/undergraduate school" and has transaction data from a transaction involving the University of North Carolina®.

In addition to the one or more product offer rules, Bank Product Datastore 468 may also include the one or more bank products and/or information about the one or more bank products described herein. In at least one embodiment, Bank Product Datastore 468 provides a substantially real-time representation of the one or more bank products (or information about same) and/or of the one or more rules for offering them. Thus, when Processor 464 accesses Bank Product Datastore 468, the information stored therein is substantially current.

In addition to determining and/or offering one or more conventional bank products (e.g., student loan products, checking account products, mortgage products, etc.), Bank Product Determination System 460 may be configured to determine and/or offer one or more non-conventional products at least partially related to education, in accordance with other embodiments of the present invention. Examples of non-conventional products include information about college costs, education savings calculators, education budgets, education savings timelines, education games, and education social networks, such as messaging applications, weblogs, forums, and bulletin boards.

In some embodiments, Bank Product Determination System 460 may determine and/or offer these one or more non-conventional products based at least partially on the one or more education position identifiers assigned to the bank customer. For example, Bank Product Determination System 460 may be configured to determine and/or offer a bank customer that has been assigned the education position identifier "college/undergraduate school" an access to a bank-maintained secure social network for college students applying to graduate school. In this example, this determination and/or offer may be based on a product offer rule stored in Bank Product Datastore 468 that assumes that college and undergraduate students are interested in post-graduate education. As another example, Bank Product Determination System 460 may be configured to determine and/or offer an interactive education savings calculator to a bank customer that has been assigned the education position "pre-school" based on a product offer rule that assumes that bank customers having pre-school children are likely interested in how to save for their children's education over an extended period of time.

Further, in other embodiments of the present invention, Bank Product Determination System 460 may determine and/or offer one or more products to a bank customer based at least partially on information other than, or in addition to, the one or more education position identifiers described herein. Examples include any information in the bank customer's transaction data, information about the bank customer's geographic location, information about the bank customer provided by third-parties, information about the bank customer provided by the bank customer herself, and/or information about the bank customer from a network, such as the Internet, etc.

More specifically, in at least one embodiment, Bank Product Determination System 460 is configured to determine and/or offer a bank customer one or more bank products based at least partially on where the bank customer makes purchases and/or engages in transactions. In at least one embodiment, this information is obtained from the bank customer's transaction data. For example, a portion of Student Prospects Assessment System 400 may determine and/or assign a geographic location position identifier "Charlotte, N.C." to any bank customer involved in a transaction occurring within the city limits of Charlotte, N.C. In other embodiments, the portion may also be configured to determine and/or assign one or more geographic location position identifiers to transaction data involving a bank customer, instead of, or in addition to, the bank customer himself. For simplicity, however, much of the following description refers to assigning one or more geographic location position identifiers to a bank customer. Further, the geographic location position identifiers described herein may be defined as narrowly or as broadly as needed. For example, in the above example, the geographic location position identifier may be "South End, Charlotte, N.C." if the transaction took place in the South End neighborhood of Charlotte, N.C. In addition, the one or more geographic location position identifiers may be appended to the bank customer's transaction data. For simplicity, however, much of the following description refers to assigning one or more geographic location position identifiers to a bank customer.

It should be understood that Bank Product Determination System 460 may assign the one or more geographic location position identifiers itself, or some other device in, or separate from, Student Prospects Assessment System 400 may do it instead. In one embodiment, a Bank Location Detection System (not shown) is operatively coupled to Student Prospects Assessment System 400 and is configured to determine and/or assign the one or more geographic position location identifiers. Similar to the other systems of Student Prospects Assessment System 400, the Bank Location Detection Location System may include a communication interface, a processor, and a memory having a location detection application and a location detection datastore.

After one or more geographic location position identifiers are assigned to a bank customer, Bank Product Determination System 460 is configured, in some embodiments, to determine and/or offer the bank customer a bank product at least partially related to the one or more geographic location position identifiers. So, in the example above, after the geographic location position identifier "Charlotte, N.C." is assigned to the bank customer, Bank Product Determination System 460 may be configured to determine and/or offer the bank customer a home mortgage product having interest rates germane to Charlotte, N.C. Bank Product Determination System 460 may also be configured to determine and/or offer the bank customer an access to a secure social network maintained by the bank that allows the bank customer to communicate with other users located in the Charlotte, N.C. area.

In another embodiment, Bank Product Determination System 460 is configured to determine and/or offer one or more products to a bank customer based at least partially on information provided by the bank customer himself. Bank Product Determination System 460 may be configured to communicate with the bank customer directly, or some other device in, or separate from, Student Prospects Assessment System 400 may do it instead. In one embodiment, a Bank Education Savings Plan System (not shown) is operatively coupled to Student Prospects Assessment System 400 and is configured to send/receive education savings information to/from the bank customer. Similar to the other systems of Student Prospects Assessment System 400, the Bank Education Savings Plan System may include a communication interface, a processor, and a memory having an education savings plan application and an education savings plan datastore. For example, a bank customer may use Bank Customer Terminal 420 to communicate to the Bank Education Savings Plan System that she wishes to save at least $50,000 over 10 years for expected college tuition costs for her daughter. In such a case, Bank Product Determination System 460 may be configured to receive this information from the Bank Education Savings Plan System and determine and/or offer the bank customer a 529 plan, savings account, and/or some other bank product tailored to fit the bank customer's savings goals.

It should be understood that Bank Product Determination System 460 may be configured to offer the bank customer one or more bank products in a variety of ways. For example, Bank Product Determination System 460 may offer the bank customer a bank product over a network, such as directly through Bank Customer Terminal 420. Bank Product Determination System 460 may also offer a bank product to the bank customer indirectly, such as by placing advertisements for bank products in other education products used by the bank customer. For example, an advertisement for a student loan product may be advertised within an education savings calculator program. In other embodiments, Bank Product Determination System 460 may be configured to relay information about what products to offer a bank customer to one or more bank associates, so that the bank associates may offer the one or more products to the bank customer via more traditional channels, including via telephone, e-mail, text message, fax, direct mailing, etc. For example, if a bank sales associate accesses a bank customer's profile while he is on the phone with the bank customer, Bank Product Determination System 460 may be configured to determine and/or recommend one or more bank products to offer the bank customer via a pop-up window on the bank sales associate's computer screen.

It should be understood that, similar to Student Prospects Assessment System 300, some or all of the portions of Student Prospects Assessment System 400 may be combined into a single portion, i.e. Bank Education Position Identifier Determination System 440 and Bank Product Determination System 460 may be combined into a single Bank Education Position Identifier and Product Determination System configured to perform all of the same functions for those separate portions as described herein. Likewise, some or all of the portions of Student Prospects Assessment System 400 may be separated into two or more distinct portions, i.e. Bank Product Determination System 460 may be separated into a Bank Product Determination System and a Bank Product Offering System.

Referring now to FIG. 5, an exemplary flow diagram illustrating the general process flow 500 of a Student Prospects Assessment System is provided in accordance with one embodiment of the present invention. As represented by block 510, a bank customer uses a Bank Customer Terminal to enroll in the bank's education program. As represented by block 520, a Bank Education Position Identifier Determination System determines and assigns an education position identifier to the bank customer based at least partially on transaction data from a transaction involving the bank customer that is stored in a Bank Transaction Data System. As represented by block 530, a Bank Location Detection System determines and assigns a geographic location position identifier to the bank customer based at least partially on transaction data from a transaction involving the bank customer that is stored in the Bank Transaction Data System. As represented by block 540, a Bank Product Determination System communicates with the Bank Transaction Data System and determines and offers the bank customer through the Bank Customer Terminal a bank product that is at least partially related to the bank customer's assigned education position identifier and geographic location position identifier.

In one embodiment of the present invention, Student Prospects Assessment System 400 is configured to implement general process flow 500. For example, as represented by block 510, a bank customer may use Bank Customer Terminal 420 to enroll in the bank's education program. As represented by block 520, Bank Education Position Identifier Determination System 440 may determine and assign an education position identifier to the bank customer based at least partially on transaction data from a transaction involving the bank customer that is stored in Bank Transaction Data System 450. As represented by block 530, a Bank Location Detection System (not shown in FIG. 4 but described herein) determines and assigns a geographic location position identifier to the bank customer based at least partially on transaction data from a transaction involving the bank customer that is stored in Bank Transaction Data System 450. As represented by block 540, Bank Product Determination System 460 communicates with Bank Transaction Data System 450 and determines and offers the bank customer through Bank Customer Terminal 420 a bank product that is at least partially related to the bank customer's assigned education position identifier and geographic location position identifier.

In some embodiments, general process flow 500 may include fewer, additional, and/or different events. For example, general process flow 500 may include the event of notifying the bank customer of the education position identifier and/or geographic position identifier assigned and prompting the bank customer to verify the accuracy of the assignment. As another example, general process flow 500 may include the event of the bank customer submitting education-related information about himself or about a member of his household to one or more portions of the Student Prospects Assessment System, including, for example, the Bank Education Savings Plan System mentioned herein. Also, one or more series of events of general process flow 500 may reiterated. For example, the events represented by blocks 520, 530, and 540 may be repeated every time additional transaction data from a transaction involving the bank customer is stored in the Bank Transaction Data System. As another example, the additional notification and verification event mentioned above may be repeated each and every time an education position identifier and/or geographic location position identifier is determined and/or assigned.

Also, the order of the events described in FIGS. 4 and 5 may vary in other embodiments of the invention. For example, a Bank Education Position Identifier Determination System may determine and/or assign an education position identifier before, after, or substantially simultaneous with a Bank Location Detection Engine determining and assigning a geographic location position identifier. As another example, a Bank Education Position Identifier Determination System may determine and assign an education position identifier before, after, or substantially simultaneous with a bank customer using a Bank Customer Terminal to enroll in the bank's education program.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. A system comprising:

a communication interface configured to receive transaction data from a transaction involving a consumer and a business merchant; and a non-transitory computer-readable medium comprising computer program code stored thereon, wherein said computer program code is specifically configured to cause one or more computer processing devices to perform the following operations when performing the computer program code:

determine an education position based at least partially on a comparison of the transaction data to an education position rule, wherein the education position comprises one or more education position identifiers configured to be appended to the transaction data involving the consumer and business merchant, and wherein the education position rule relates at least partially to information associated with two or more education levels for transaction data;

append, at least, one of the one or more education position identifiers to the transaction data involving the consumer and the business merchant.

2. The system of claim 1, wherein the computer program code is specifically configured to cause one or more computer processing devices to determine a product offer for the consumer based at least partially on the education position.

3. The system of claim 2, wherein the computer program code is specifically configured to cause one or more computer processing devices to offer the product offer to the consumer.

4. The system of claim 1, wherein the education position is at least partially related to an education level.

5. The system of claim 1, wherein the computer program code is specifically configured to cause one or more computer processing devices to determine a geographic location position based at least partially on a comparison of the transaction data to a geographic location position rule, and wherein the processor is further configured to determine a product offer for the consumer based at least partially on the geographic location position and the education position.

6. The system of claim 1, wherein the education position is directed to a member of the consumer's household.

7. The system of claim 1, wherein the education position rule relates at least partially to the business-merchant.

8. The system of claim 1, wherein the transaction further involves a product, and wherein the education position rule relates at least partially to the product.

9. The system of claim 1, wherein the transaction further involves a time, and wherein the education position rule relates at least partially to the time.

10. The system of claim 1, wherein the computer program code is specifically configured to cause one or more computer processing devices to assign the education position to the consumer.

11. The system of claim 1, wherein the transaction involves a business-merchant, and wherein the computer program code is specifically configured to cause one or more computer processing devices to assign the education position to the business-merchant.

12. The system of claim 1, wherein the processor is further configured to assign the education position to the transaction data.

13. The system of claim 1, wherein the communication interface is further configured to communicate the education position to the consumer for verification.

14. The system of claim 1, wherein the communication interface is further configured to receive information about the consumer from the consumer, wherein the processor is further configured to determine an education position based at least partially on a comparison of the information to an education position rule, and wherein the processor is further configured to determine a product offer for the consumer based at least partially on the education position.

15. A computer-implemented method comprising:

providing a non-transitory computer-readable medium comprising computer program code stored thereon, wherein said computer program code is specifically configured to cause one or more computer processing devices to perform the following operations when performing the computer program code:

receiving transaction data from a transaction involving a consumer and one or more other parties;

comparing the transaction data to an education position rule, wherein the education position rule relates at least partially to information associated with two or more education levels for transaction data; and determining an education position based at least partially on a comparison of the transaction data to an education position rule, wherein the education position comprises one or more education position identifiers configured to be appended to the transaction data involving the consumer and business merchant;

appending, at least, one of the one or more education position identifiers to the transaction data involving the consumer and the business merchant.

16. The computer-implemented method of claim 15, further comprising computer program code is specifically configured to cause one or more computer processing devices to perform the following operations when performing the computer program code:

determining a product offer for the consumer based at least partially on the education position.

17. The computer-implemented method of claim 16, further comprising computer program code is specifically configured to cause one or more computer processing devices to perform the following operations when performing the computer program code:

offering the product offer to the consumer.

18. The computer-implemented method of claim 15, further comprising computer program code is specifically configured to cause one or more computer processing devices to perform the following operations when performing the computer program code:

comparing the transaction data to a geographic location position rule, determining a geographic location position based at least partially on a comparison of the transaction data to a geographic location position rule, and determining a product offer for the consumer based at least partially on the geographic location position and the education position.

19. The computer-implemented method of claim 15, wherein the transaction further involves a business-merchant, and wherein the education position rule relates at least partially to the business-merchant.

20. The computer-implemented method of claim 15, wherein the transaction further involves a product, and wherein the education position rule relates at least partially to the product.

21. The computer-implemented method of claim 15, wherein the transaction further involves a time, and wherein the education position rule relates at least partially to the time.

22. The computer-implemented method of claim 15, further comprising computer program code is specifically configured to cause one or more computer processing devices to perform the following operations when performing the computer program code:

assigning the education position to the consumer.

23. The computer-implemented method of claim 15, wherein the transaction involves a business-merchant, and further comprising assigning the education position to the business-merchant.

24. The computer-implemented method of claim 15, further comprising computer program code is specifically configured to cause one or more computer processing devices to perform the following operations when performing the computer program code:

assigning the education position to the transaction data.

25. The computer-implemented method of claim 15, further comprising computer program code is specifically configured to cause one or more computer processing devices to perform the following operations when performing the computer program code:

communicating the education position to the consumer for verification.

26. The computer-implemented method of claim 15, further comprising computer program code is specifically configured to cause one or more computer processing devices to perform the following operations when performing the computer program code:

receiving information about the consumer from the consumer, comparing the information to an education position rule, determining an education position based at least partially on a comparison of the information to an education position rule, and determining a product offer for the consumer based at least partially on the education position.

27. A computer program product comprising a non-transitory computer-readable medium having computer-readable program instructions stored therein, wherein said computer-readable program instructions comprise:

instructions configured to receive transaction data from a transaction involving a consumer and one or more other parties;

instructions configured to compare the transaction data to an education position rule, wherein the education position rule relates at least partially to information associated with two or more education levels for transaction data; and instructions configured to determine an education position based at least partially on a comparison of the transaction data to an education position rule, wherein the education position comprises one or more education position identifiers configured to be appended to the transaction data involving the consumer and business merchant;

instructions configured to append, at least, one of the one or more education position identifiers to the transaction data involving the consumer and the business merchant.

28. The computer program product of claim 27, further comprising instructions configured to determine a product offer for the consumer based at least partially on the education position.

29. The computer program product of claim 28, further comprising instructions configured to offer the product offer to the consumer.

30. The computer program product of claim 27, further comprising instructions configured to compare the transaction data to a geographic location position rule, instructions configured to determine a geographic location position based at least partially on a comparison of the transaction data to a geographic location position rule, and instructions configured to determine a product offer for the consumer based at least partially on the geographic location position and the education position.

31. The computer program product of claim 27, and wherein the education position rule relates at least partially to the business-merchant.

32. The computer program product of claim 27, wherein the transaction further involves a product, and wherein the education position rule relates at least partially to the product.

33. The computer program product of claim 27, further comprising instructions configured to assign the education position to the consumer.

34. A system comprising:

a communication interface configured to receive transaction data from a transaction involving a consumer and one or more other parties;

a memory configured to store an education position-identifying rule; and a computer processing device operatively coupled to the communication interface and the memory, wherein the memory comprises a non-transitory computer-readable medium comprising computer program code stored thereon, wherein said computer program code is specifically configured to cause the computer processing device to perform the following operations when performing the computer program code:

determine an education position identifier based at least partially on a comparison of the transaction data to an education position-identifying rule, wherein the education position identifier comprises one or more education position identifiers configured to be appended to the transaction data involving the consumer and business merchant, and wherein the education position rule relates at least partially to information associated with two or more education levels for transaction data;

append, at least, one of the one or more education position identifiers to the transaction data involving the consumer and the business merchant.

35. The system of claim 34, wherein the computer program code is specifically configured to cause one or more computer processing devices to determine a product offer for the consumer based at least partially on the education position identifier.

36. The system of claim 35, wherein the computer program code is specifically configured to cause one or more computer processing devices offer the product offer to the consumer.

37. The system of claim 34, wherein the computer program code is specifically configured to cause one or more computer processing devices to determine a geographic location position identifier based at least partially on a comparison of the transaction data to a geographic location position-identifying rule, and wherein the computer program code is specifically configured to cause one or more computer processing devices to determine a product offer for the consumer based at least partially on the geographic location position identifier and the education position identifier.

38. The system of claim 34, wherein the education position-identifying rule relates at least partially to the business-merchant.

39. The system of claim 34, wherein the transaction further involves a product, and wherein the education position-identifying rule relates at least partially to the product.

40. The system of claim 34, wherein the computer program code is specifically configured to cause one or more computer processing devices to assign the education position identifier to the consumer.

41. A computer-implemented method comprising:

providing anon-transitory computer-readable medium comprising computer program code stored thereon, wherein said computer program code is specifically configured to cause one or more computer processing devices to perform the following operations when performing the computer program code:

receiving transaction data from a transaction involving a consumer and a business-merchant;

comparing the transaction data to an education position-identifying rule, wherein the education position-identifying rule relates at least partially to information associated with two or more education levels for transaction data; and determining an education position identifier based at least partially on a comparison of the transaction data to an education position-identifying rule, wherein the education position identifier comprises one or more education position identifiers configured to be appended to the transaction data involving the consumer and business merchant;

appending, at least, one of the one or more education position identifiers to the transaction data involving the consumer and the business merchant.

42. The computer-implemented method of claim 41, further comprising computer program code is specifically configured to cause one or more computer processing devices to perform the following operations when performing the computer program code:

determining a product offer for the consumer based at least partially on the education position-identifier.

43. The computer-implemented method of claim 42, further comprising computer program code is specifically configured to cause one or more computer processing devices to perform the following operations when performing the computer program code:

offering the product offer to the consumer.

44. The computer-implemented method of claim 41, further comprising computer program code is specifically configured to cause one or more computer processing devices to perform the following operations when performing the computer program code:

comparing the transaction data to a geographic location position-identifying rule, determining a geographic location position identifier based at least partially on the comparison of the transaction data to a geographic location position-identifying rule, and determining a product offer for the consumer based at least partially on the geographic location position identifier and the education position identifier.

45. The computer-implemented method of claim 41, wherein the education position-identifying rule relates at least partially to the business-merchant.

46. The computer-implemented method of claim 41, wherein the transaction further involves a product, and wherein the education position-identifying rule relates at least partially to the product.

47. The computer-implemented method of claim 41, further comprising computer program code is specifically configured to cause one or more computer processing devices to perform the following operations when performing the computer program code:

assigning the education position identifier to the consumer.

48. A system comprising:

a communication interface configured to receive an education position, wherein the education position is determined based at least partially on transaction data from a transaction involving a consumer and a business-merchant, wherein the education position comprises one or more education position identifiers configured to be appended to the transaction data involving the consumer and business merchant;

a memory configured to store a product offer rule; and a computer processing device operatively coupled to the communication interface and the memory, wherein the memory comprises a non-transitory computer-readable medium comprising computer program code stored thereon, wherein said computer program code is specifically configured to cause the computer processing device to perform the following operations when performing the computer program code:

append, at least, one of the one or more education identifiers to the transaction data involving the consumer and the business merchant; and determine a product offer for the consumer based at least partially on a comparison of the transaction data appended with the, at least, one of the one or more education position identifiers to a product offer rule.

49. The system of claim 48, wherein the computer program code is specifically configured to cause one or more computer processing devices to offer the product offer to the consumer.

50. The system of claim 48, wherein the communication interface is further configured to receive a geographic location position, wherein the geographic location position is based at least partially on transaction data from a transaction involving a consumer, and wherein the computer program code is specifically configured to cause one or more computer processing devices to determine a product offer for the consumer based at least partially on a comparison of the geographic location position to a product offer rule and a comparison of the education position to a product offer rule.

51. The system of claim 48, wherein the communication interface is further configured to receive information about the consumer from the consumer, and wherein the computer program code is specifically configured to cause one or more computer processing devices to determine a product offer based at least partially on a comparison of the information to a product offer rule.

52. The system of claim 48, wherein the transaction further involves a product, and wherein the product offer rule relates at least partially to the product.

53. The system of claim 48, wherein the transaction further involves a time, and wherein the product offer rule relates at least partially to the time.

54. The system according to claim 1, wherein the transaction data involving a consumer and business merchant is received from a bank, wherein the consumer is a customer of the bank.

* * * * *